United States Patent [19]

Crowell

[11] Patent Number: 4,998,850

[45] Date of Patent: Mar. 12, 1991

[54] GEL DISPENSING APPARATUS AND METHOD

[75] Inventor: Terry M. Crowell, Twin Lakes, Wis.

[73] Assignee: Park Corporation, Barrington, Ill.

[21] Appl. No.: 477,623

[22] Filed: Feb. 9, 1990

Related U.S. Application Data

[63] Continuation-in-part of Ser. No. 266,797, Nov. 3, 1988, abandoned.

[51] Int. Cl.[5] ..... B67D 5/08

[52] U.S. Cl. ..... 406/48; 222/52; 222/185

[58] Field of Search ..... 406/46, 47, 48, 154, 406/181, 195; 222/52, 67, 185, 187, 193; 422/266

[56] References Cited

U.S. PATENT DOCUMENTS

| | | | |
|---|---|---|---|
| 2,938,751 | 5/1960 | Nogami | 406/48 |
| 3,494,331 | 2/1970 | Eckert | 406/154 |
| 3,545,438 | 12/1970 | De Vries . | |
| 4,020,865 | 5/1977 | Moffat et al. . | |
| 4,063,663 | 12/1977 | Larson et al. . | |
| 4,335,982 | 6/1982 | Bratschitsch | 406/48 |
| 4,426,362 | 1/1984 | Copeland et al. . | |
| 4,569,781 | 2/1986 | Fernholz et al. . | |
| 4,685,843 | 8/1987 | Kelm | 406/181 |
| 4,773,960 | 9/1988 | Vincelli et al. | 406/48 |

OTHER PUBLICATIONS

Mar-Tech Laboratories Product Information, Mar--Tech Laboratories, Barrington, Ill.

Mar-Tech Laboratories, New Horizons Sales brochure, Mar-Tech Laboratories, Barrington, Ill.

*Primary Examiner*—Sherman Basinger
*Assistant Examiner*—Stephen P. Avila
*Attorney, Agent, or Firm*—McAndrews, Held & Malloy, Ltd.

[57] ABSTRACT

A detergent dispenser and method of using the dispenser are disclosed. One dispenser embodiment is a hydraulic type and the other a demand type. Both dispensers utilize a venturi valve in a controlled water line to draw gravity fed material such as a gel into the venturi valve, mix the material with the water in the valve, and deliver the resulting solution to a wash area. The demand dispenser has a conductivity sensor and control to control dispensing of detergent solution to the wash area.

29 Claims, 7 Drawing Sheets

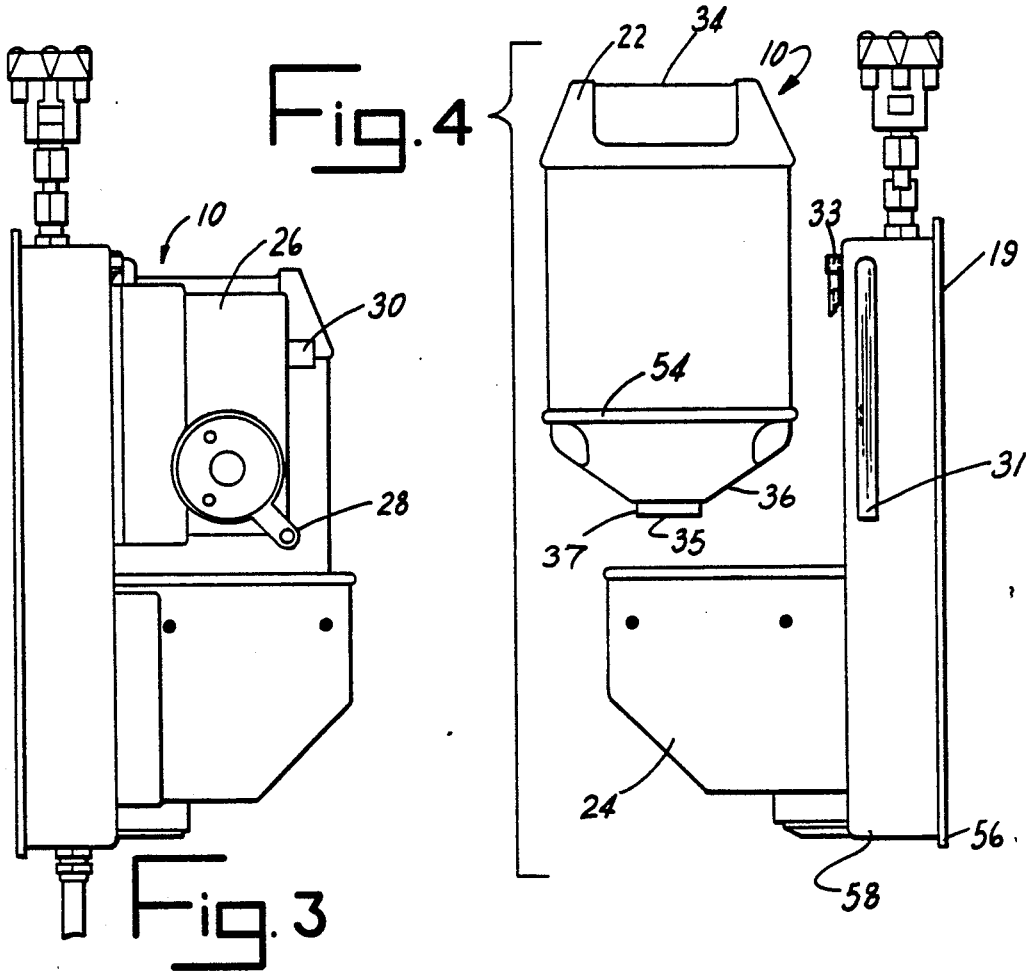
Fig. 4
Fig. 3
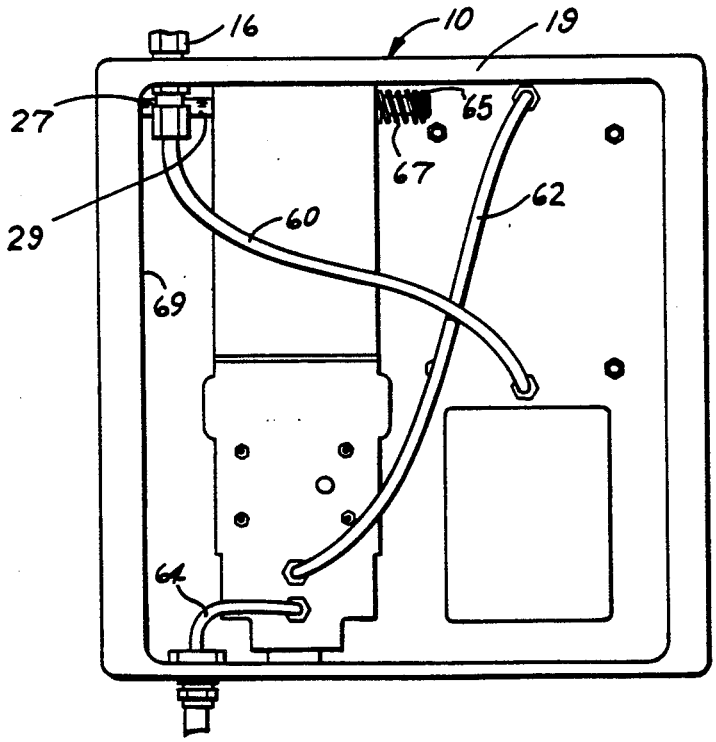
Fig. 5

GEL DISPENSING APPARATUS AND METHOD

RELATED APPLICATION

This application is a continuation-in-part of applicant's prior application, Ser. No. 07/266,797, filed Nov. 3, 1988, now abandoned.

TECHNICAL FIELD

The present invention relates to dispensing apparatus and methods. More particularly, this invention relates to methods and apparatus for dispensing detergents, especially geltypes, which applicant has found are particularly useful for institutional dish washing and fabric washing machines.

BACKGROUND OF THE PRIOR ART

There are a wide variety of institutional and industrial washing machines in the prior art. One such machine maintains a detergent solution in a reservoir for use by a washing machine. During operation, the machine draws upon or washes within the detergent solution in the reservoir until drained or replenished by fresh solution. In order to maintain a desired concentration of detergent in the reservoir, concentrated detergent must be added periodically to the reservoir.

In commercial and industrial applications, cost, safety, and quality considerations often require that the washing system minimize operator involvement in the process of adding or "charging" the detergent concentrate into the reservoir. Operator involvement is often unnecessarily time consuming and costly, and the detergent concentrate is sometimes caustic and unsafe for handling by an operator. Moreover, many washing operations require very precise machine control of detergent concentration in the reservoir—too low and the washing is less than complete; too high and the washing leaves an undesirable and sometimes unsafe residue.

Commercial and industrial washing systems therefore frequently accomplish charging with an automatic or semi-automatic detergent dispensing apparatus having a fairly large capacity for detergent concentrate. By automating the charging process, these dispensers attempt to minimize labor costs, operator errors or injury, inaccuracy or inconsistency of detergent concentration, and inadequate or unsafe cleaning.

One type of detergent dispensing apparatus is the "demand" dispenser. In the demand dispenser, a conductivity cell forms an electrical bridge or comparator to monitor detergent concentration in the solution emitted from or within the washing machine itself. When the conductivity of the solution in the machine goes above or below a predetermined level, the cell signals the dispenser to either cease or commence dispensing detergent solution until the concentration reaches a desired level, at which point the exact opposite "demand" is made by the conductivity cell or comparator.

In the prior art demand systems, the conductivity cell or comparator is often separate from the actual dispenser which the cell or comparator controls. In addition, the prior art demand systems often work in combination with separately mounted rinse pump apparatus to deliver rinse water when activated by a separately mounted controller. They have thus often required the user to acquire, mount, and maintain a variety of components at separated locations.

Another type of prior art dispenser is hydraulically activated. In one such hydraulic system, a by-pass line from the rinse line is hydraulically linked to the detergent dispenser. Each execution of a rinse cycle activates the dispenser to dispense detergent concentrate in predetermined proportion to the volume of rinse water used. The rinse water in the by-pass is diverted back to the wash tank to mix with both fresh rinse water and injected detergent concentrate to maintain the desired detergent concentration.

Such hydraulic systems suffer from the inherent degradation of the wash solution by the rinse water feedback. They also do not provide precise control of detergent concentration in the wash water.

In these prior art detergent dispensers, the detergent concentrate has typically been liquid or solid. Liquid systems and solid systems both have major drawbacks.

In one liquid concentrate system, for example, a canister of liquid concentrate rests under the wash basin or machine, typically on the floor. A detergent supply line extends from the bottle to a venturi valve mounted on a water delivery line over the wash basin or machine reservoir. Water flow in the water delivery line generates a venturi effect in the venturi valve to draw liquid detergent concentrate from the canister into the supply line and then into the water delivery line to mix with the wash water as it is delivered into the wash basin or machine reservoir.

Liquid concentrate is, however, very heavy and bulky compared to solid detergent concentrates. The weight is difficult for the operator to manage, and the large bulk takes up space and requires much greater storage and shipping expense. Since ease of use and storage and shipping costs are often the dominant factors in determining which system to use, solid concentrate systems are much more prevalent in commercial and industrial applications.

One prevalent solid concentrate system utilizes powdered detergent stored in a translucent plastic supply container. The container is provided with a capped top for storage and shipping. A meshed screen, with apertures finer than the grains of detergent powder, spans the top under the cap. When used, the cap is removed, the container is inverted, the meshed screen is centered over a receptacle on the dispenser, and the inverted container is lowered into the receptacle until it rests securely in place within the receptacle.

A spray nozzle is centered in the receptacle below the meshed screen and above an underlying drain. The spray nozzle sprays fresh water upwards through the meshed screen, which atomizes the spray as it continues upward into the powdered detergent supported over the screen. The powdered detergent concentrate directly overlying the screen is dissolved into the solution, which falls back into the underlying drain. The detergent solution is directed from the drain into a conduit for delivery to a wash basin or machine.

In high volume applications of this type and others as well, the shipping container is large and also serves as the supply container, usually remote from washing apparatus. Examples of such applications are shown in U.S. Pat. Nos. 3,545,438 and 4,020,865.

In lower volume applications, the detergent dispenser is frequently located on or adjacent the wash basin or machine, and the container is much smaller for ease of insertion into the dispenser. One example is disclosed in U.S. Pat. No. 4,063,663.

There are other powdered dispensers. See, for example, U.S. Pat. No. 4,426,362. These and the other powder detergent dispensers have solved a variety of problems, but they too suffer from problems.

For instance, due to increased sanitary standards and demands for shorter wash times, recently developed powdered detergents have relatively complex detergent compositions. These complex detergent compositions are more hazardous to the user, less stable, and more difficult to dissolve in a satisfactorily uniform manner. For a detailed discussion of these problems, see the U.S. patent application referenced in U.S. Pat. No. 4,426,362.

Another problem arises when the powdered detergent includes a mixture of components having differing dissolving rates. Powdered detergents dissolve relatively rapidly because of their high specific areas. Powdered detergents with components having differing dissolving rates will thus yield significantly varying solution composition over relatively short periods of time.

Yet another problem arises when components of the detergent are relatively unstable. An example is a detergent requiring an active chlorine source with an organic defoamer. Due to the instability of the chlorine component, the available chlorine can be lost well before going into the intended the solution. The chlorine instability problem is even more acute with high alkalinity powdered detergents. Many defoamers and chlorine components, for example, are even more unstable in the presence of highly alkaline chemicals, like sodium hydroxide.

Powdered detergents often also have the problem of segregation or stratification of the powdered particles during manufacturing, shipping, handling, etc. Segregation can lead to non-uniform dissolving of the components which have settled to different levels or concentrated at different locations in the container.

Powders also often clog the screen as the spray partially dissolves powders immediately above the screen and the weight of the undissolved powder above jams the partially dissolved powder into screen apertures. The screen thus becomes clogged, sometimes partially and sometimes wholly. If only partially, the rate of dissolving becomes less uniform and reduced (slowing the washing process) as the clog blocks access to powder over the clog. If anywhere near wholly blocked, the clog brings the wash process to a halt until the clog is removed by the operator, either by cleaning or replacing the screen or by replacing the entire container of detergent powder. Either result yields significant problems for the wash process.

One attempt to solve at least some of these problems is the solid-block detergent system disclosed in U.S. Pat. No. 4,426,362. In this system, a container, much like the containers for the smaller volume powder applications described above, contains a solid block of detergent concentrate substantially filling the inside of the container. This block detergent container is also placed in an inverted position in a retaining receptacle, and a water nozzle sprays water upwardly into the container against the solid detergent. The water dissolves the detergent into solution, which, like the powder system described above, then falls back into an underlying drain for delivery to a reservoir and use in washing. The main difference of this system from the other well-known prior-art small-volume powder systems described above, is thus the use of a solid, consistent block of detergent concentrate in the place of powders.

This solid block system does not solve all the problems of powders. The solid block system also raises problems of its own. One problem of the solid block system is the inherent non-uniformity of detergent concentration in the solution it generates. Applicant believes this is caused by several physical limitations on the solid block system.

First, the solid block of detergent is positioned vertically over the spray nozzle so that the upwardly directed spray is always subject to the ever-present downward pull of gravity. Over time, the spray dissolves the lowermost portion of the block, so that the remaining detergent is located further away upwardly from the nozzle. Over time, the spray must travel further and further upwardly from the nozzle and against gravity to reach the surface of the remaining portion of the solid block detergent concentrate. Thus, over time, the force or impact of the spray against the solid block becomes weaker and weaker.

Second, the solid block is sloped so that the neck of the container is narrow at the opening adjacent the nozzle and widens as the vertical distance from the spray nozzle increases. The constant amount of spray from the nozzle must impact a larger and larger surface area, with less and less upward velocity, as the detergent block dissolves upwardly from the neck opening further upwardly into the sloped neck.

A detergent solution of inconsistent concentration results. The concentration becomes weaker and weaker as the block detergent dissolves and the spray must travel a greater distance upwards to cover a wider and wider area.

Another problem is waste. The uppermost portion of the solid block is difficult to dissolve with sufficient concentration, and in any event, cannot all be dissolved by upward spray as desired since the uppermost portion may eventually crumble and fall leading to non-uniform dissolving as with powders. The remaining undissolved solid detergent is thus unusable and wasted. The waste often reaches as much as 10% of the detergent concentrate, which the user must, of course, pay for.

A further problem with the solid block system is the bulk, i.e., volume and weight, of the solid block detergent. Although less bulky than powder detergent concentrate, the solid block detergents occupy significant volume and have substantial weight, especially since most solid block detergents consist of about 15–20% moisture.

Of course, bulk is also a concern for powdered and liquid systems as well.

An additional problem with some of these prior art dispenser systems is the ease of using the wrong detergent concentrate in the wrong environment. Many of the prior art containers are physically interchangeable so that, for example, both a caustic detergent and an identically contained pot and pan cleaner will fit on the same dispenser. A person washing pots and pans can thus burn his or her hands or incur other problems if the wrong container is inserted into the dispenser.

SUMMARY OF THE INVENTION

The dispensing system of the present invention utilizes a flowable detergent, preferably a gel concentrate, and dispenses the detergent into a fluid stream by a venturi valve drawing a relatively constant amount of the flowable detergent into the fluid stream. The preferred gel detergent concentrate and dispensing apparatus and method provide particularly uniform concentration of the detergent solution from the entire concentrate container, while virtually eliminating the problem of clogging. In a particularly preferred embodiment, the system yields almost no waste, and it reduces the chance of inadvertent insertion of the wrong container into the dispenser.

One preferred embodiment of the present dispenser system is hydraulic, and the another is demand type. In both, all components are mounted on one base unit, making acquisition, installation, and maintenance much easier. Having all components on one base unit provides more precise control of detergent concentration, with less effort and expense, than the systems of the prior art.

BRIEF DESCRIPTION OF THE DRAWINGS

The accompanying drawings depict the two preferred embodiments of the present invention wherein:

FIG. 3 is a left side elevational view of the dispensing panel of the hydraulic dispenser;

FIG. 4 is a right side exploded view of the hydraulic dispenser panel with the inverted container separated from the container receptacle;

FIG. 5 is a rear elevational view of the hydraulic dispenser panel showing the conduit between the timer-controller and the container receptacle;

DETAILED DESCRIPTION OF THE PREFERRED EMBODIMENTS

Figure 1:
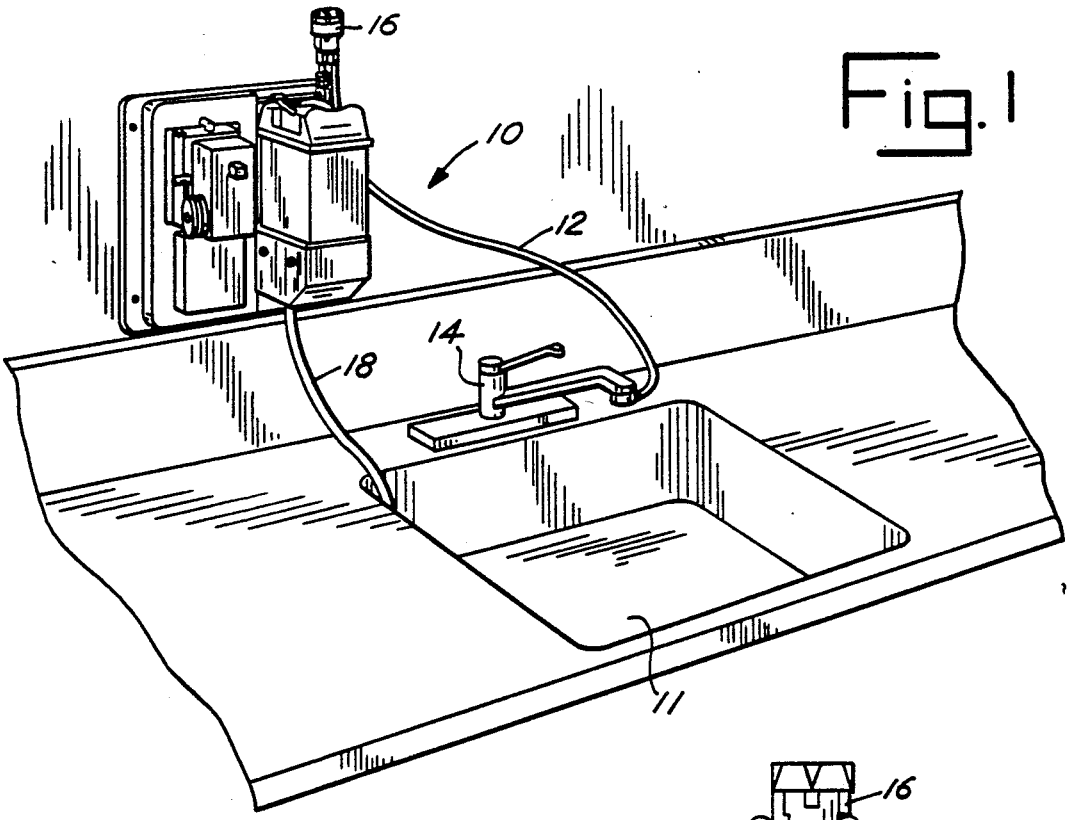
FIG. 1 is a pictorial view of the preferred hydraulic dispensing system.

With reference to FIG. 1, the hydraulic embodiment of the present invention, generally 10, is intended for use in industrial or commercial hand washing applications, such as for pots and pans in a sink. In such applications, the detergent must not be too alkaline for extended contact with the operator's hands. In addition, the amount of detergent dispensed should be adequate for the job without being excessive.

The hydraulic dispenser 10 is wall mounted just over the sink 11. The hydraulic dispenser 10 has a flexible plastic inlet tube 12 extending from the sink faucet 14 or water supply plumbing into a vacuum breaker 16 on the dispenser 10. The hydraulic dispenser 10 also has a flexible detergent solution discharge tube 18 extending from the bottom of the dispenser 10 into the sink 12 below.

Figure 2:
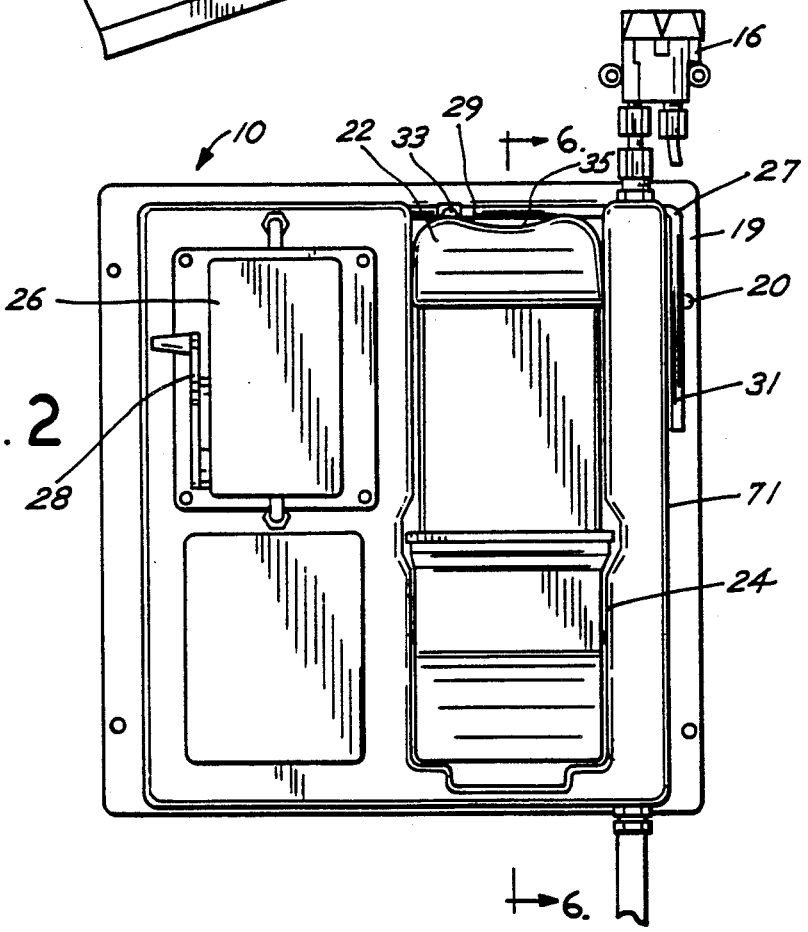
FIG. 2 is a front elevational view of the hydraulic dispensing panel, which includes the inverted container mounted in a receptacle adjacent a hydraulic timer-controller.

As shown in FIG. 2, the hydraulic dispenser 10 has a wall base plate 19 secured to the wall (not shown in FIG. 2) by four support fasteners 20 of the type readily available in the art. The vacuum breaker 16 extends vertically upwardly from the base plate 19 to distribute water from the faucet to the components of the dispenser 10. A detergent container 22 is removably mounted within a receptacle 24 on the base plate 19 adjacent and below the vacuum breaker 16. The detergent container 22 preferably contains a flowable detergent material such as a fluid or gel. Most preferably, the flowable detergent is a gel.

A water flow timer-controller 26 is also mounted on the base plate 19 adjacent the receptacle 24 and detergent container 22. An air venting arm 27 is rotatably mounted on the base plate 19 adjacent the detergent container 22. The venting arm 27 is "L" shaped, with a horizontal section 29 disposed above the container 22 and a vertical arm section 31 disposed to the side of the container 27. The arm section 31 is thus rotatable vertically around the axis of the horizontal section 29 to raise and lower a venting ram 33, which penetrates and thus vents the top 35 of the container 22 when (as also shown in FIG. 7) the arm section 31 is rotated downwardly into vertical alignment adjacent the container 22 and base plate 19.

Figure 7:
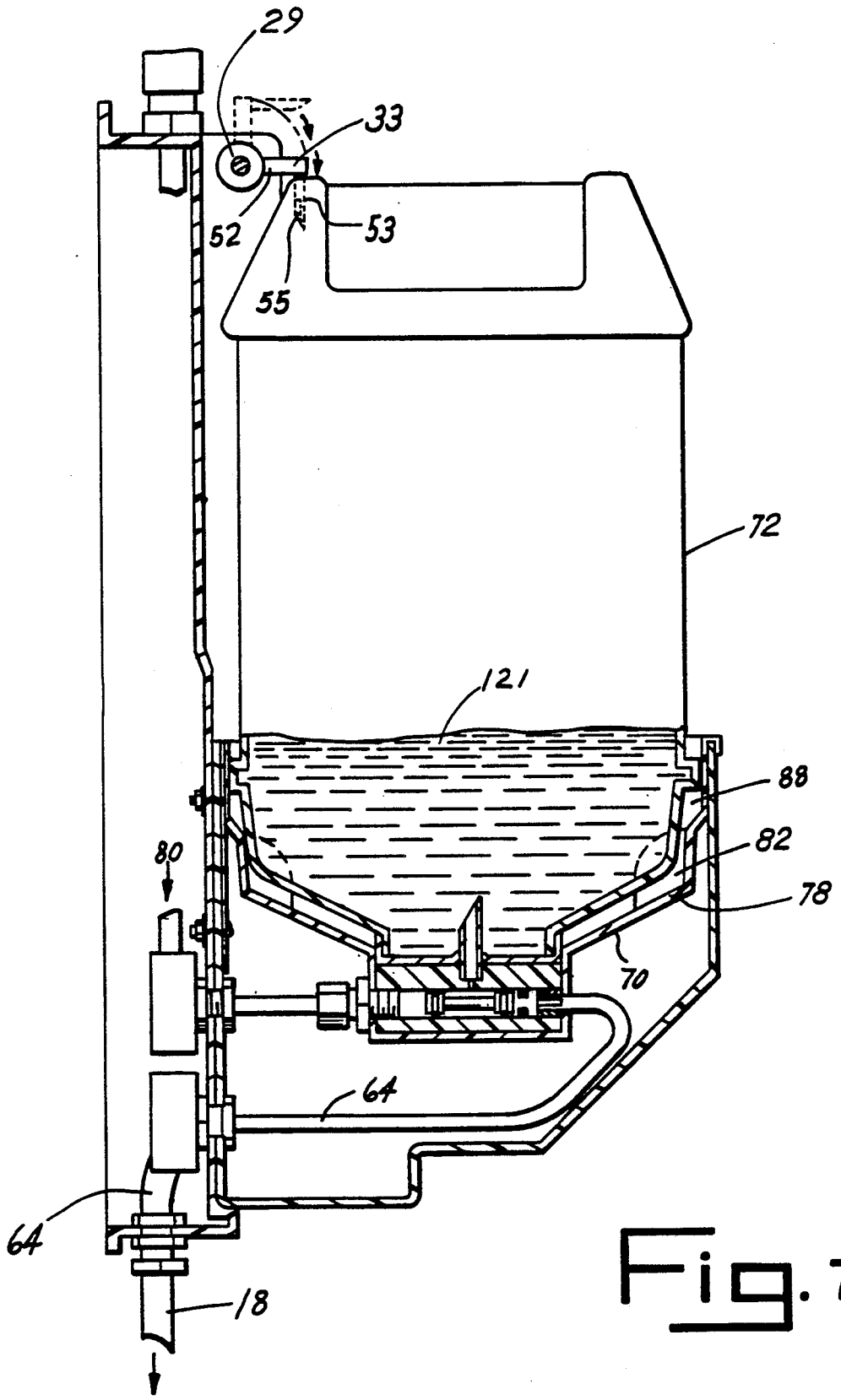
FIG. 7 is a cross-sectional view taken along section line 6—6 of FIG. 2, with the container inserted into the receptacle vertically over the venturi valve.

With reference to FIG. 7, the venting ram 33 has (1) a ram arm 51 perpendicularly extending from the horizontal section 29; and (2) a ram lance 53 perpendicularly extending from the ram arm 51. The ram lance 53 has an air venting slot 55 extending along its entire axial length. The air venting slot 55 vents air flow from the inside of container 22 to the area external of the container 22.

Referring back to FIG. 2, the timer-controller 26 has an activation lever 28 rotatable by the operator downwardly in a vertical plane to spring-load the lever 28 to rotate back to the unloaded state of FIG. 2. Rotation of the lever 28 as far downwardly as possible (as shown in FIG. 3) compresses an internal spring (not shown) to urge the lever toward the un-loaded state. Thus, when the operator releases the lever 28, the urging force of the internal loaded spring (not shown) rotates the lever 28 to its un-loaded state (shown in FIG. 2) at a uniform rate of rotation. The timer-controller 26 has internal valving that opens to allow fluid flow through the timer-controller 26 for the period of rotation of the lever 28 or, alternatively, for the period during which the operator depresses the override button 30 on the controller 26.

Referring now to FIG. 4, the detergent container 22 is inverted prior to insertion into the receptacle 24 of the dispenser 10. The detergent container 22 is plastic and non-breakable with a flat bottom 32 for storage of the detergent container 22 prior to or after use in the dispenser 10. Opposite the flat bottom 32 is a capped detergent passage 34 in the somewhat conically sloped upper end 36 of the container 22.

Figure 9:
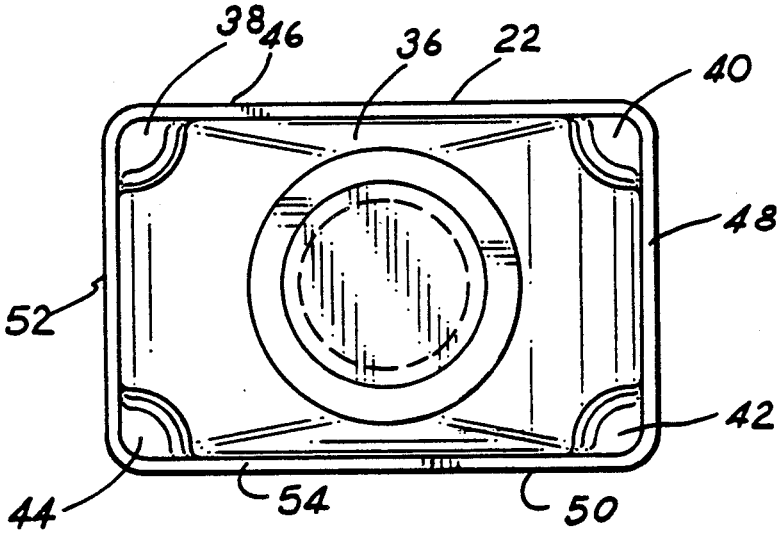
FIG. 9 is a bottom plan view of a container having four alignment detents for mating engagement with the aligning projections shown in FIG. 8.

As shown in FIG. 9, the detergent passage 35 is circular and centered in the upper end 36 of the container 22. The cap 37 on the detergent passage 35 is made of plastic that is puncturable by a sharpened rigid object, such as a gel drawing tube 39 shown in FIG. 6.

In the embodiment of FIG. 9, the container's upper end 36 has four rounded and dimpled corners 38, 40, 42, 44 intermediate the junction of the upper end 36 and the four side walls 46, 48, 50, 52 of the container 22. As shown in both FIGS. 4 and 9, the junction of the upper end 36 and side walls 46, 48, 50, 52 includes a neck band 54 projecting outwardly from the generally planar side walls 46, 48, 50, 52 of the container 22.

The base plate 19 has a substantially rectangular wall frame 56 for flush mounting on the wall (not shown in FIG. 4). The frame 56 flanges outwardly from a central dispenser module 58 projecting from the frame 56 away from the wall. In turn, the container receptacle 24 projects horizontally outwardly from the dispenser module 58 on the side of the module 58 opposite the side facing the wall.

Referring now to FIG. 5, the central dispenser module 58 contains feed lines or tubes to and from the various components of the dispenser 10. The water distribution valve 16 connects through the dispenser module 58 wall to a timer-controller feed tube 60 to deliver water under pressure to the timer-controller (26 in FIG. 3); a venturi feed tube 62 delivers water under pressure from the timer-controller 26 through the wall of the dispenser module 58 into the receptacle (24 in FIG. 3); and a dispensing tube 64 delivers detergent solution from the receptacle through the wall of the dispenser module 58 to the dispenser discharge tube 18.

As also show in FIG. 5, the horizontal section 29 of the venting arm 27 is secured in the base plate by a C-clip 65 and spring 67. The spring 67 is disposed between the C-clip 65 and an inner vertical plate wall 69 to urge the arm section 31 into frictional contact with, as shown in FIG. 2, an outer sectional plate wall 71. This frictional contact assures that the venting arm 27 will remain in the up or down position (see FIG. 7) as desired by the operator.

Figure 6:
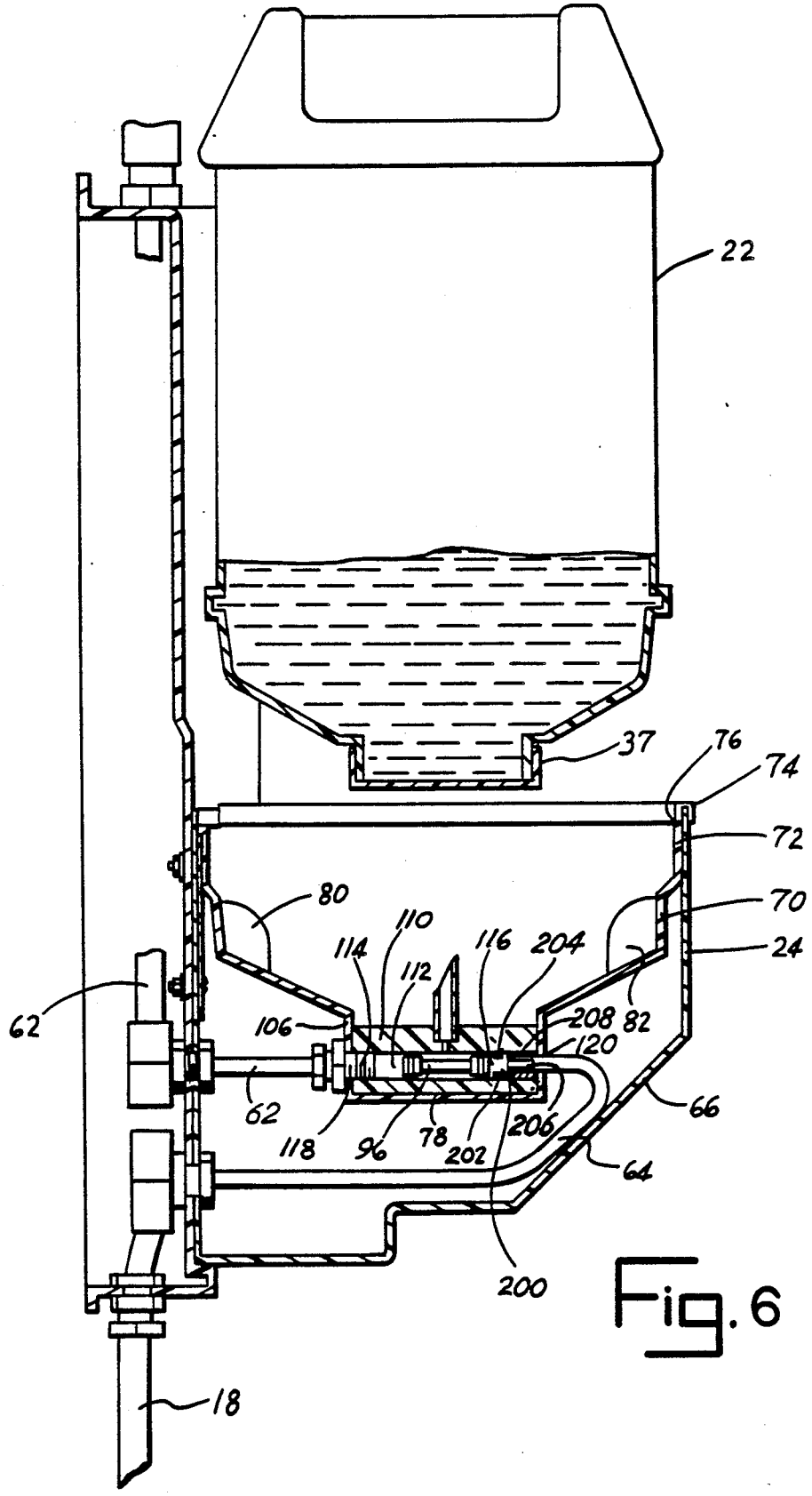
FIG. 6 is a cross-sectional view taken along section line 6—6 of FIG. 2, with the container aligned above an interchangeable container receptacle for insertion into the receptacle vertically over the venturi valve.
Figure 8:
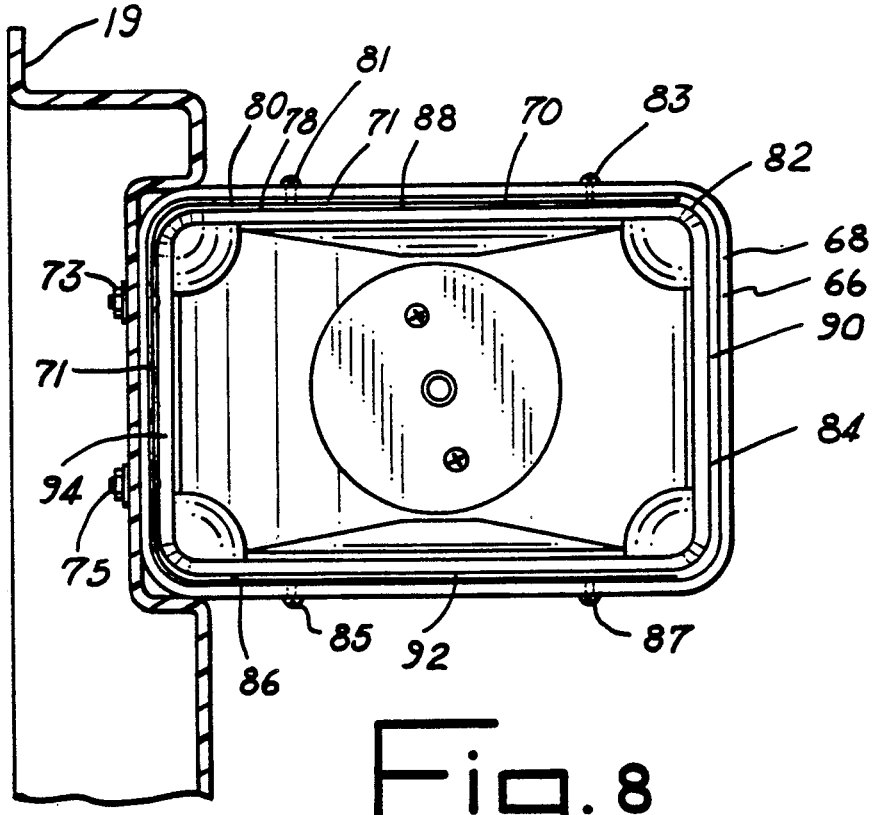
FIG. 8 is a partial cross-sectional view taken along section line 8—8 of FIG. 6, showing the four rounded container aligning projections, one in each of the four corners of the interchangeable receptacle.

Referring now to FIG. 6, the receptacle 24 has an outer housing 66 secured to he wall of the dispenser module 56. As shown in FIG. 8, the outer housing 66 has a substantially rectangular upper section 68. A removable container bowl 70 has a substantially rectangular upper portion 72 with an external periphery slidably retained within and abutting the internal periphery of the upper housing section 68. As shown in FIG. 6, an outwardly curled lip 74 on the uppermost edge 76 of the container bowl 70 clasps the upper section 68 to hold the container bowl 70 in place within the housing 66.

As shown in FIG. 8, the container bowl 70 has a somewhat rectangularly-bounded bottom 78 with, as shown in FIGS. 7 and 8, rounded projections 80, 82, 84, 86 extending upwardly from the bottom 78 and inwardly from the four internal side walls 88, 90, 92, 94 of the container bowl 70. The four projections 80, 82, 84, 86 mate with, as shown in FIG. 9, the obversely configured dimples 38, 40, 42, 44. The projections 80, 82, 84, 86 extend upwardly, as shown in FIGS. 6 and 7, sufficiently to prevent the insertion of a container not having mating dimples 38, 40, 42, 44.

As also shown in FIG. 8, the rectangular upper section 68 of the housing 66 is rigidly secured in position on the base plate 19 by a metal U-bracket 71. The U-bracket 71 is secured to the base plate with two base plate screws 73, 75 that penetrate the base plate 19 and thread into mating threaded passages in the U-bracket 71. Similarly, the U-bracket 71 is also secured to the upper section 68 with four additional screws 81, 83, 85, 89 that penetrate the upper section 68 and thread in mating threaded passages in the U-bracket 71.

Referring to FIG. 6, the container bowl 70 is slidably removable upwardly and outwardly from the housing 66. In this manner, bowls having different internal configurations and differently arranged projections or no projections at all, can be selectively inserted by the operator or permanently secured in place by the manufacturer, user, etc. The particular bowl chosen and inserted can then limit the types of gel containers insertable into the receptacle housing. For example, if the four-projection bowl of FIG. 6 is inserted and mates with obversely arranged dimples only present on non-caustic gel containers and no others, the operator is automatically prevented from inadvertently inserting a dangerous caustic gel container into the receptacle.

Still referring to FIG. 6, a venturi valve 96 is maintained horizontally in a horizontal venturi passage 112 in a circular venturi retaining disk 110 slidably inserted into a mating cylindrical valve detent 106 in the bottom 78 of the bowl 70. The venturi passage 112 has a water inlet end 114 opposite a solution outlet end 116. Midway between the two ends 114, 116 is the upwardly extending, vertical gel drawing tube 39. The gel drawing tube 39 serves two functions: to puncture the plastic cap 37 in the gel container 22 and to, as shown in FIG. 7, penetrate into the lowermost portion of the gravity fed gel 122 in the container 22 and draw gel 122 to the venturi valve 96 on demand by the valve 96 when water is forced through the valve 96.

As shown in FIG. 6, the water inlet end 114 of the venturi passage 112 communicates with and is secured to the venturi water feed tube 62 through a detent inlet passage 118 in the valve detent 106. Similarly, the solution outlet end 116 communicates with and is secured to the dispensing tube 64 through a detent outlet passage 120 in the valve detent 106. The outlet end 116 has a land portion 200, a raceway 202 in the land portion, a resilient seal 204 in the raceway 202, and a tube mounting cylinder 206 extending from the land portion 200 in the direction of outlet passage 120. The end 208 of the dispensing tube 64 is slidably retained over the mounting cylinder 206 and held securely in place on the cylinder 206 by a locking ring 208. The locking ring 208 has an outer diameter less than the inner diameter of the venturi passage 112 but greater than the inner diameter of the outlet passage 120. The locking ring 208 grips the outer periphery of the tube 64 to prevent inadvertent separation of the tube 64 from the cylinder 206.

The venturi valve 96 and the associated delivery tubing thus provide means for receiving water under the control of the timer-controller (not shown in FIG. 6), in order to, as shown in FIG. 7, (i) draw detergent gel 121 at a constant rate into the water as it passes through the venturi vale 96, and (ii) mix the gel 121 into solution for dispensing of the solution from the dispensing tube 64 to and then out the discharge tube 18.

In the preferred hydraulic dispenser of FIG. 2, the controller-timer 26 and vacuum breaker 16 are both manufactured by Viking Injector Company. The wall plate 19 and receptacle 24 are made of high density A.B.S. and the container 22 is made of translucent injected polyethylene, and contains about 74 ounces of gel.

With general reference now to FIGS. 1, 2, 6 and 7, the operator uses the dispenser as follows:

1. The operator selects the appropriate gel container 22 and inserts the container into the receptacle 24, making sure that the container 22 seats all the way into receptacle so that the venturi drawing tube 39 punctures and penetrates the cap 37 of the container 22.

2. If desired the operator then calibrates the dispenser 10 to determine how much detergent solution should be dispensed for each fill of the sink with the wash water. Calibration is accomplished by:

a. mounting a conventional graduated cylinder (not shown), with a hole in its bottom just large enough for the drawing tube to penetrate the hole, onto the drawing tube 39 in the receptacle 24;

b. filling the graduated cylinder with gel from an opened container 22;

c. rotating the lever 28 as far downward as possible and then activating a solution discharge cycle by releasing the lever 30 on 26; and (which causes water to flow from the feed tube 60 to the venture feed tube 62 for the entire period of rotation of the lever from its loaded state (FIG. 3) to its un-loaded state (FIG. 3));

d. observing how much gel is withdrawn from the graduated cylinder by the drawing force of the venturi valve 96 during the discharge step (c.) above.

3. Activating the dispenser when desired by rotating the lever 28 as far downward as possible and then releasing the lever 28.

Alternatively, the dispenser can be activated at any time by pressing the timer-controller override button 30 to activate fluid discharge from the feed tube 60 into the venture tube 62 for the period during which the operator depresses the button 30.

Figure 10:
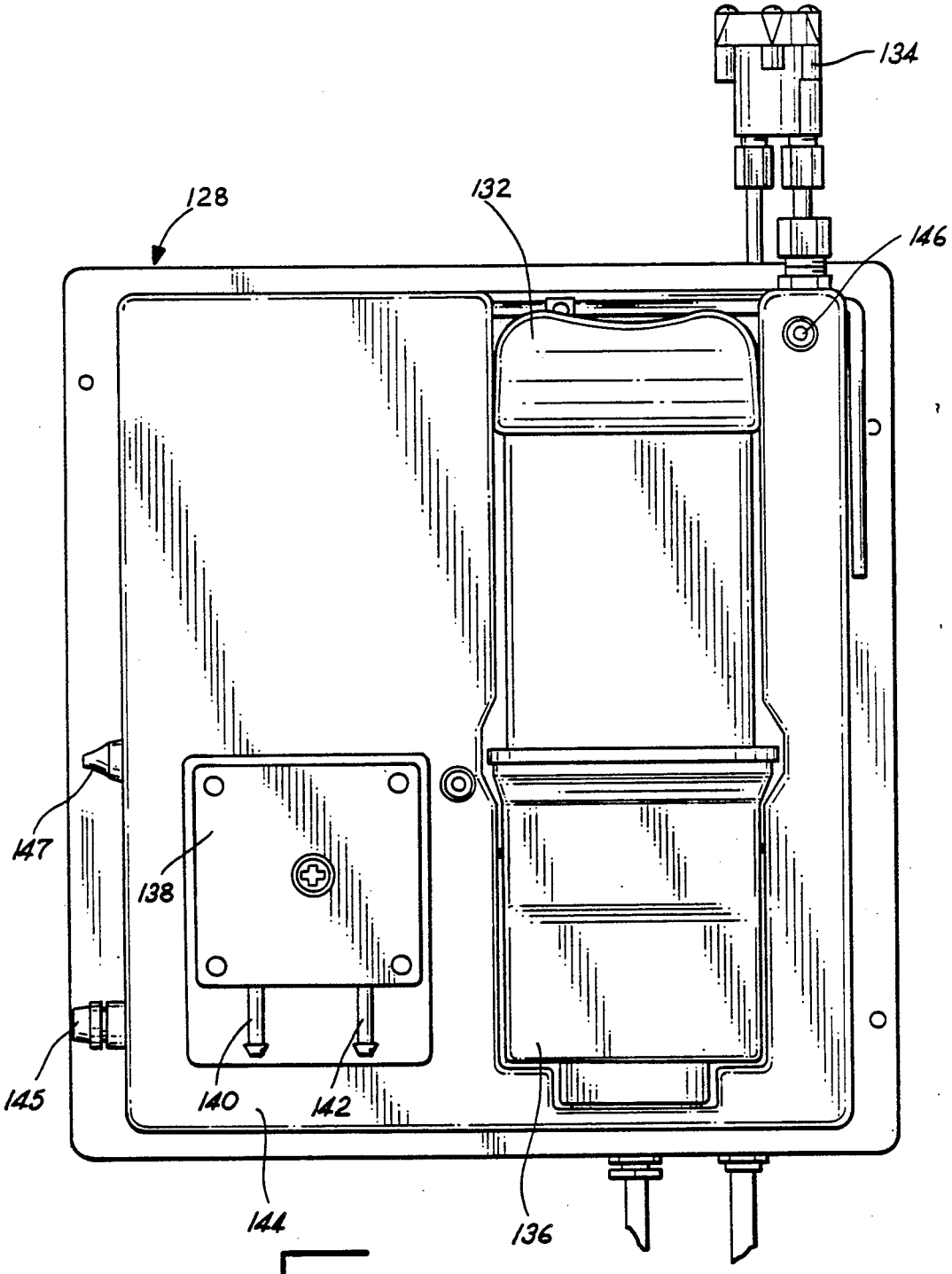
FIG. 10 is an elevational view of a preferred fully automatic demand-type dispenser, showing a rinse pump mounted on the dispenser panel adjacent the container receptacle.

With reference now to FIG. 10, applicant's preferred embodiment of the demand dispenser, generally 128, is mounted on the same type of base module 130 as discussed above. The demand dispenser 128 also utilizes the same types of containers 132 as discussed aboVe, the same type of water supply valve 134, and the same type of receptacle 136, with one exception as shown in FIG. 12. The demand dispenser receptacle 136 includes a rocker switch 160 vertically mounted in the upper portion 162 of the side walls of the receptacle housing 164 and container bowl 166 abutting the side of the module 144. This rocker switch 160 is switched automatically on or off by the neck ridge 168 on the container 132 when the container 132 is respectively inserted into or taken out of the container bowl 166 in the dispenser 128.

Referring back to FIG. 10, the demand dispenser 128 has a rinse pump 138, with an inlet line 140 and outlet line 142. The rinse pump 138 is secured within a pump mounting passage (not shown) in the wall of the module 144. The inlet and outlet lines 140, 142 are on the side of the module 144 facing away from the wall (not shown).

The demand dispenser also has an LED indicator light 146 mounted in the wall of the module 144. The LED 146 lights up whenever the dispenser 12 is in the dispensing mode.

Figure 11:
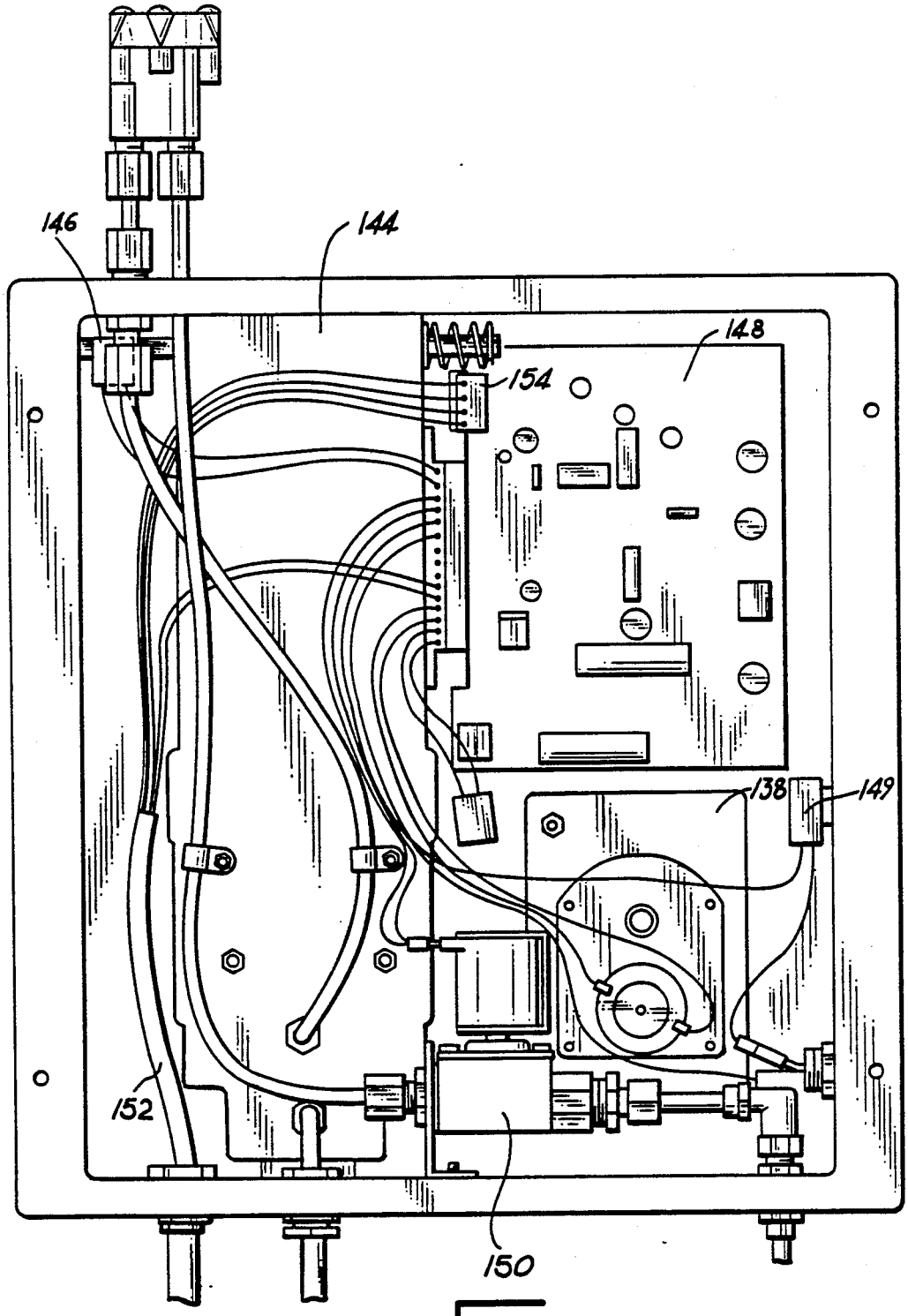
FIG. 11 is a rear elevational view of the preferred automatic demand dispenser, showing a conductivity comparator mounted on the back of the panel adjacent a rinse water pump and water supply solenoid.

As shown in FIG. 11, the interior of the module 144 provides a mounting surface for a conductivity computer and controller 148, the previously mentioned rinse pump 138, a water supply solenoid 150 controlled by the controller 148, a power supply line 149 for the controller 148, LED 146, and solenoid 150, and a conductivity sensor line 152 connected to the controller 148 at one end 154 and a conductivity sensor at the other end (not shown) mounted in, for example, the wash or rinse water area in an automatic industrial or commercial washing machine.

The operation of each of these components (LED 146, controller 148, rinse pump 138, solenoid 150, supply line 149, and sensor line 152) are known to those of skill in the art. The controller 148 is model number A0000 PCB manufactured by Tate Western Company. The rinse pump is model number 230 PC6 manufactured by Tate Western Company. The solenoid is manufactured by Hemco, Inc. The module 144 and Vacuum breaker 134 are the same as described above for the hydraulic system 10.

With general reference now to both FIGS. 10 and 11, the container 132 and the internal structure of the receptacle 136 are the same as described above for the container 22 and hydraulic receptacle 24, respectively, shown in FIGS. 6, 7, 8, and 9.

An operator uses the demand dispenser 128 by simply selecting the appropriate gel container 134 and, as shown in FIG. 12, inserting the container 134 into the receptacle 136, making sure that the container 134 seats all the way into receptacle so that the venturi drawing tube punctures and penetrates the cap of the container 134. From this point forward the dispenser operates automatically until the gel is completely drained from the container 134. When drained, the old container 134 is removed and a new container 134 is inserted.

The preferred gel detergent used in the preferred embodiment is described in the contemporaneously filed application, Ser. No. 07/266588, filed Nov. 3, 1988, entitled Gel Dishwashing Composition and Method of Making Same (inventors R. Itoku and T. Crowell), which disclosure is incorporated herein by reference. The preferred gel detergent concentrate disclosed therein is much less bulky and more concentrated then comparable prevalent detergent systems. For example, one ounce of the preferred gel pot and pan detergent concentrate provides about 150% more detergent solution than the same volume of the best selling liquid pot and pan detergent concentrate, sold by Mar-Tech. In addition, the preferred 74 ounce gel container weighs only 5 lbs. versus (i) the 8.5 lb. gallon canister of the same prior art liquid detergent, or (ii) the common, prior art 45 lb. powdered detergent 5 gallon drum. Moreover, the preferred 74 ounce gel concentrate container requires only about half of the storage and packing space required for the much less concentrated, somewhat conically-shaped prior art 1 gallon liquid concentrate canisters. The space reduction over the prior art 5 gallon drums of powdered concentrate is even greater.

The preferred hydraulic system dispenses detergent solution consistently for precisely the period of time desired, and does so without any electrical components or connections whatsoever. The preferred demand system, on the other hand, provides the same consistency of output from the venturi while maintaining ever greater precision of solution concentration by feedback control through the comparator.

The present invention thus provides the desired concentration of wash solution on the very first machine cycle, as opposed to many prior art systems, especially certain prior art solid block demand systems, which often require several wash cycles to do so.

In addition, the preferred hydraulic and demand dispensers both have all components mounted on one light-weight and easily mounted module. Both occupy very little wall space, preferably in an easily accessible location, and both require no floor space whatsoever. And unlike certain prior art solid block systems in particular, the preferred gel systems need no hot water whatsoever to accomplish complete and consistent dissolving of the detergent concentrate into the wash solution.

The preferred keyed containers 2 prevent use of the wrong type of detergent in the wrong environment. Also, the slidably removable container bowls allow the operator to convert from one type of keyed bowl to another without removing the dispenser from its mounted position.

The translucent containers 22 provide several other advantages as well. They allow the operator to quickly see (i) the color of a color-coded detergent type and (2) the amount of detergent remaining in a container. The operator is thus less likely to utilize the wrong detergent or attempt to operate the system without adequate detergent.

The preferred embodiments thus provide marked advantages over the prior art detergent dispensing systems. In essence, they provide industrial or commercial detergent solutions more economically, simply, safely, and consistently and effectively than the systems of the prior art.

While in the foregoing there has been a detailed description of the preferred embodiments, they are to be understood as illustrative and not restrictive. The scope of the invention is thus determined by the scope of the following claims.

I claim:

1. A dispensing apparatus of the type usable to dispense gel detergent to a washing apparatus, the gel dispensing apparatus comprising in combination:

(a) a uniformly dissolvable detergent gel concentrate;

(b) means for containing the gel concentrate;

(c) valve means for receiving the gel concentrate from a gel inlet and mixing the gel concentrate with a fluid from a fluid inlet to deliver the mixture to a valve outlet;

(d) means for delivering gel concentrate from the containing means to the gel inlet;

(e) means for delivering fluid to the fluid inlet; and (f) means for receiving fluid and gel solution from the valve outlet when the fluid delivering means delivers fluid under pressure into the fluid inlet, the gel delivering means delivers gel concentrate to the gel inlet, and the valve means mixes the fluid with the gel concentrate.

2. A gel dispensing apparatus of the type useable to dispense gel detergent to a washing apparatus, the gel dispensing apparatus comprising in combination:

(a) means for containing a gel;

(b) a venturi valve with a fluid inlet to a venturi passage, a gel inlet penetrating the venturi passage, and a venturi outlet extending from the end of the venturi passage opposite the fluid inlet;

(c) means for delivering gel from the containing means to the venturi valve gel inlet;

(d) means for delivering fluid to the venturi valve fluid inlet; and (e) means for receiving fluid and gel solution from the venturi outlet when the fluid delivering means delivers fluid under pressure into the venturi inlet, the gel delivering means delivers gel to the gel inlet in the venturi valve, and the venturi valve draws gel from the gel delivering means into the venturi to mix with the fluid flowing through the passage into the venturi outlet.

3. A dispensing apparatus of the type usable to dispense flowable material to a washing apparatus, the dispensing apparatus comprising in combination:

(a) means for containing a flowable material, the containing means including a container support and a material container supported by the container support and having a material passage;

(b) a venturi valve with a fluid inlet to a venturi passage, a material inlet penetrating the venturi passage, and a venturi outlet extending from the end of the venturi passage opposite the fluid inlet, the venturi valve being mounted below the container support;

(c) means for delivering flowable material from the material container to the material inlet in the venturi valve, the material delivering means including a material delivery tube extending from the venturi valve upwardly through the material passage into the material container, whereby a flowable material in a container in the container support can gravity feed downwardly into the material delivery tube and from the delivery tube into the material inlet in the venturi valve;

(d) means for delivering fluid to the venturi valve fluid inlet; and (e) means for receiving fluid and material solution from the venturi outlet when the fluid delivering means delivers fluid under pressure into the venturi inlet, the material delivering means delivers flowable material to the flowable material inlet in the venturi valve, and the venturi valve draws flowable material from the material delivering means into the venturi to mix with the fluid flowing through the passage into the venturi outlet.

4. The dispensing apparatus of claim 3 wherein (i) the flowable material container includes a puncturable seal across the material passage, (ii) the container support includes a seal access section, and (iii) the material delivery tube has a venturi junction end and a rigid end extending vertically upwardly from the junction end through the seal access section to penetrate the material passage in the material container, the rigid end providing means for penetrating the puncturable seal when the material container is mounted on the container support.

5. The dispensing apparatus of claim 4 wherein (i) the container has at least one identifying detent, and (ii) the container support includes a mating detent projection, whereby the detent projection penetrates the identifying detent in order for the rigid end of the venturi to penetrate the puncturable seal in the material passage in the material container.

6. The dispensing apparatus of claim 2 wherein the containing means, venturi valve, material delivering means, fluid delivery means and solution receiving means are all mounted on a central module and wherein the combination also includes hydraulic means for controlling fluid flow through the venturi valve.

7. The dispensing apparatus of claim 3 wherein the containing means, venturi valve, flowable material delivering means, fluid delivering means and solution receiving means are all mounted on a central module and wherein the combination also includes:

(a) means for delivering rinse water to a separate wash apparatus; and (b) means for sensing the concentration of solution dispensed by the dispenser apparatus and controlling fluid flow through the venturi valve and the rinse water delivering means, the rinse water delivering means and controlling means also being mounted on the central module of the dispensing apparatus.

8. The dispensing apparatus of claim 3 wherein the flowable material is a gel.

9. The dispensing apparatus of claim 6 wherein the flowable material is a gel.

10. The dispensing apparatus of claim 7 wherein the flowable material is a gel.

11. The dispensing apparatus of claim 8 including a venting arm means for venting the containing means on the apparatus.

12. The dispensing apparatus of claim 9 including a venting arm means for venting the containing means on the apparatus.

13. The dispensing apparatus of claim 10 including a venting arm means for venting the containing means on the apparatus.

14. A method of dispensing gel detergent for mixture of a gel with a fluid to yield a detergent solution, the method including the steps of:

(a) delivering a uniformly dissolvable detergent gel concentrate to a mixing valve whereby the gel concentrate is fed into a mixing passage in the mixing valve;

(b) delivering fluid under pressure to the mixing valve whereby the valve draws the gel concentrate into the mixing passage to mix with the fluid so as to create a fluid and gel mixture; and (c) receiving the fluid and gel mixture from the passage and delivering the mixture to a desired wash area.

15. A method of dispensing gel detergent for mixture of the gel with a fluid, the method including the steps of;

(a) suspending a uniformly dissolvable detergent gel concentrate directly over a venturi valve whereby the gel is gravity fed into the valve;

(b) delivering fluid under pressure to the venturi valve whereby the venturi valve draws the gel concentrate into a passage to mix with the fluid; and (c) receiving the fluid and gel mixture from the passage and delivering the mixture to a desired area.

16. A method of dispensing gel detergent for mixture of a gel with a fluid to yield a detergent solution, the method including the steps of:

(a) delivering a gel detergent to a mixing valve whereby the gel is fed into a mixing passage in the mixing valve;

(b) delivering fluid under pressure to the mixing valve whereby the valve draws the gel into the mixing passage to mix with the fluid so as to create a fluid and gel mixture; and (c) receiving the fluid and gel mixture from the passage and delivering the mixture to a desired wash area.

(d) measuring the concentration of the mixture as used in the desired area;

(e) terminating the delivering step (b) and the receiving and delivering step (c) when the measured concentration exceeds a first predetermined level; and (f) reinitiating the delivering step (b) and the receiving and delivering step (c) when the measured concentration falls below a second predetermined level.

17. A method of dispensing gel for mixture of the gel with a fluid, the method including the steps of;

(a) suspending a first gel in a measuring container over a venturi valve whereby the first gel is gravity fed into the valve;

(b) actuating a hydraulic control to deliver fluid under pressure to the venturi valve for a preset period of time, whereby the venturi valve draws the first gel from the measuring container into a passage to mix with the fluid for the preset period of the hydraulic control;

(c) receiving the fluid and gel mixture from the passage and delivering the mixture to a desired area;

(d) determining the amount of the first gel drawn from the measuring container in steps (A), (B), and (C) in order to determine the number of actuating steps to perform in a future receiving and delivering step;

(e) suspending a second gel in a second container over the venturi valve whereby the second gel is gravity fed into the valve;

(f) actuating the hydraulic control to deliver fluid under pressure to the venturi valve for the preset period of time, whereby the venturi valve draws the second gel from the second container into the passage to mix with the fluid for the preset period of the hydraulic control;

(g) receiving the fluid and second gel mixture from the passage and delivering the mixture to a desired area; and (h) repeating steps G and H for the number of times determined in step (D).

18. The method of claim 17 wherein step (a) also includes venting the gel container.

19. The dispensing apparatus of claim 3 wherein the containing means, venturi valve, material delivering means, fluid delivery means and solution receiving means are all mounted on a central module and wherein the combination also includes hydraulic means for controlling fluid flow through the venturi valve.

20. The dispensing apparatus of claim 4 wherein the containing means, venturi valve, material delivering means, fluid delivery means and solution receiving means are all mounted on a central module and wherein the combination also includes hydraulic means for controlling fluid flow through the venturi valve.

21. The dispensing apparatus of claim 5 wherein the containing means, venturi valve, material delivering means, fluid delivery means and solution receiving means are all mounted on a central module and wherein the combination also includes hydraulic means for controlling fluid flow through the venturi valve.

22. The dispensing apparatus of claim 4 wherein the containing means, venturi valve, material delivering means, fluid delivering means and solution receiving means are all mounted on a central module and wherein the combination also includes:

(a) means for delivering rinse water to a separate wash apparatus; and (b) means for sensing the concentration of solution dispensed by the dispenser apparatus and controlling fluid flow through the venturi valve and the rinse water delivering means, the rinse water delivering means and controlling means also being mounted on the central module of the dispensing apparatus.

23. The dispensing apparatus of claim 5 wherein the containing means, venturi valve, material delivering means, fluid delivering means and solution receiving means are all mounted on a central module and wherein the combination also includes:

(a) means for delivering rinse water to a separate wash apparatus; and (b) means for sensing the concentration of solution dispensed by the dispenser apparatus and controlling fluid flow through the venturi valve and the rinse water delivering means, the rinse water delivering means and controlling means also being mounted on the central module of the dispensing apparatus.

24. The dispensing apparatus of claim 4 wherein the flowable material is a gel.

25. The dispensing apparatus of claim 5 wherein the flowable material is a gel.

26. A method of dispensing gel detergent for mixture of the gel with a fluid, the method including the steps of;

(a) suspending a gel detergent directly over a venturi valve whereby the gel is gravity fed into the valve;

(b) delivering fluid under pressure to the venturi valve whereby the venturi valve draws the gel into a passage to mix with the fluid; and (c) receiving the fluid and gel mixture from the passage and delivering the mixture to a desired area;

(d) measuring the concentration of the mixture as used in the desired wash area;

(e) terminating the delivering step (b) and the receiving step (c) when the measured concentration exceeds a first predetermined level;

(f) reinitiating the delivering step (b) and the receiving step (c) when the measured concentration falls below a second predetermined level.

27. The flowable material dispensing apparatus of claim 3 wherein (i) the flowable material means includes a flowable material container support, (ii) the venturi valve is mounted below the flowable material container support, and (iii) the flowable material delivering means includes a flowable material delivery tube extending from the venturi valve upwardly towards the container support, whereby a flowable material in a flowable material container in the container support can gravity feed downwardly into the flowable material tube and from the delivery tube into the flowable material inlet in the venturi valve.

28. The flowable material dispensing apparatus of claim 27 wherein the flowable material is a gel.

29. A method of dispensing gel detergent for mixture of a gel with a fluid to yield a detergent solution, the method including the steps of:

(a) venting the gel container;

(b) delivering a gel detergent to a mixing valve whereby the gel is fed into a mixing passage in the mixing valve;

(c) delivering fluid under pressure to the mixing valve whereby the valve draws the gel into the mixing passage to mix with the fluid so as to create a fluid and gel mixture;

(d) receiving the fluid and gel mixture from the passage and delivering the mixture to a desired wash area;

(e) measuring the concentration of the mixture as used in the desired wash area;

(f) terminating the delivering step (b) and the receiving and delivering step (c) when the measured concentration exceeds a first predetermined level; and (g) reinitiating the delivery step (c) and the receiving and delivering step (d) when the measured concentration falls below a second predetermined level.

* * * * *